US009771186B1

(12) United States Patent
Stinchfield

(10) Patent No.: US 9,771,186 B1
(45) Date of Patent: Sep. 26, 2017

(54) SHIPPING BAG WITH NON-REGISTERING HANDLE

(71) Applicant: Bag Strategies and Solutions, LLC, Apple Valley, MN (US)

(72) Inventor: Jim Stinchfield, Apple Valley, MN (US)

(73) Assignee: Bag Strategies and Solutions, LLC, Apple Valley, MN (US)

( * ) Notice: Subject to any disclaimer, the term of this patent is extended or adjusted under 35 U.S.C. 154(b) by 0 days.

(21) Appl. No.: 15/185,096

(22) Filed: Jun. 17, 2016

(51) Int. Cl.

| | |
|---|---|
| ***B65D 33/10*** | (2006.01) |
| ***B65D 33/26*** | (2006.01) |
| ***B65D 30/06*** | (2006.01) |
| ***B65D 33/02*** | (2006.01) |
| ***B65D 33/28*** | (2006.01) |
| ***B31B 37/00*** | (2006.01) |

(52) U.S. Cl.
CPC ..... *B65D 33/26* (2013.01); *B31B 37/00* (2013.01); *B65D 29/04* (2013.01); *B65D 33/02* (2013.01); *B65D 33/28* (2013.01); *B31B 2219/23* (2013.01); *B31B 2237/20* (2013.01)

(58) Field of Classification Search
CPC ..... B65D 33/26; B65D 29/04; B65D 33/02; B65D 33/28; B31B 37/00; B31B 2219/23; B31B 2237/20
USPC .... 383/9, 10, 78, 79, 83, 89, 90, 92, 14, 16, 383/17, 20, 11
See application file for complete search history.

(56) References Cited

U.S. PATENT DOCUMENTS

| | | | | |
|---|---|---|---|---|
| 2,050,967 | A * | 8/1936 | Farmer | B65D 33/10 383/14 |
| 2,093,977 | A * | 9/1937 | Farmer | B65D 65/10 383/14 |
| 2,242,857 | A * | 5/1941 | Fortuin | B65D 33/26 383/79 |
| 2,625,318 | A | 1/1953 | Ross | |
| 2,947,464 | A * | 8/1960 | Newton | B65D 33/10 383/14 |
| 3,282,493 | A | 11/1966 | Kamins et al. | |
| 3,565,328 | A | 2/1971 | Hudson | |
| 3,850,366 | A | 11/1974 | Saito | |
| 3,990,626 | A | 11/1976 | Goodrich | |
| 4,148,431 | A * | 4/1979 | Lepisto | B65D 33/10 383/14 |
| 4,373,979 | A | 2/1983 | Planeta | |
| 4,709,399 | A | 11/1987 | Sanders | |
| 4,877,336 | A | 10/1989 | Peppiatt | |
| 4,902,140 | A | 2/1990 | Branson | |
| 4,913,693 | A | 4/1990 | Ball et al. | |
| 5,059,033 | A | 10/1991 | Branson | |

(Continued)

FOREIGN PATENT DOCUMENTS

| | | | |
|---|---|---|---|
| EP | 2974978 | A1 | 1/2016 |
| WO | 2008050135 | A1 | 5/2008 |
| WO | 2012016742 | A1 | 8/2012 |

*Primary Examiner* — Jes F Pascua
(74) *Attorney, Agent, or Firm* — Haugen Law Firm PLLP

(57) ABSTRACT

A handled shipping bag or sack is described that is capable of manufacture without requiring registration of the handle to a width of the bag. The shipping bag includes a cover tape having perforations particularly well suited for finger holds of a user that center the users hand relative to the width of the bag without requiring a registration of the finger holds relative to the bag during the manufacture of the bag.

22 Claims, 11 Drawing Sheets

(56) References Cited

U.S. PATENT DOCUMENTS

| | | | |
|---|---|---|---|
| 5,116,140 | A | 5/1992 | Hirashima |
| 5,145,258 | A | 9/1992 | Schneck et al. |
| 5,155,967 | A | 10/1992 | Branson |
| 5,174,657 | A | 12/1992 | Peppiatt |
| 5,290,104 | A | 3/1994 | Sengewald |
| 5,749,657 | A | 5/1998 | May |
| 5,782,562 | A | 7/1998 | Anspacher |
| 6,126,316 | A | 10/2000 | Bannister |
| 6,146,016 | A | 11/2000 | Mucci et al. |
| 6,176,615 | B1 | 1/2001 | Leimkuehler |
| 6,367,976 | B1 | 4/2002 | Bannister |
| 6,701,557 | B2 | 3/2004 | Barman |
| 6,957,914 | B2 | 10/2005 | Arends et al. |
| 7,419,300 | B2 | 9/2008 | Pawloski et al. |
| 7,537,387 | B2 | 5/2009 | Spork et al. |
| 8,142,340 | B2 | 3/2012 | Mantzivis |
| 8,309,192 | B2 | 11/2012 | Meseguer Huertas |
| 8,317,977 | B2 | 11/2012 | Black et al. |
| 8,322,923 | B2 | 12/2012 | Gum |
| 8,535,209 | B2 | 9/2013 | Sargin |
| 8,784,967 | B2 | 7/2014 | Frei et al. |
| 8,844,246 | B2 | 9/2014 | Perick et al. |
| 8,857,134 | B2 | 10/2014 | Lucas et al. |
| 8,979,369 | B2 | 3/2015 | Jenkins et al. |
| 9,067,364 | B2 | 6/2015 | Fuerst et al. |
| 9,139,339 | B2 | 9/2015 | Pang et al. |
| 9,162,801 | B2 | 10/2015 | Mallard |
| 9,233,502 | B2 | 1/2016 | Sargin et al. |
| 9,238,343 | B2 | 1/2016 | Selle et al. |
| 2005/0063624 | A1 | 3/2005 | Goto et al. |
| 2006/0182369 | A1 | 8/2006 | Schneider et al. |
| 2008/0085065 | A1 | 4/2008 | Nowak et al. |
| 2008/0089619 | A1 | 4/2008 | Wayhan |
| 2011/0082019 | A1 | 4/2011 | Bannister |
| 2011/0103721 | A1 | 5/2011 | Sargin et al. |
| 2011/0176753 | A1 | 7/2011 | Nowak et al. |
| 2013/0016926 | A1 | 1/2013 | Koehn et al. |
| 2013/0189461 | A1 | 7/2013 | Bashir et al. |
| 2013/0330028 | A1 | 12/2013 | Bannister et al. |
| 2014/0170359 | A1 | 6/2014 | Schwitte et al. |
| 2015/0030265 | A1 | 1/2015 | Stoeppelmann et al. |
| 2015/0052857 | A1 | 2/2015 | Hefner et al. |
| 2015/0183194 | A1 | 7/2015 | Lehmann et al. |

* cited by examiner

SHIPPING BAG WITH NON-REGISTERING HANDLE

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to side gusseted bags or sacks that are especially useful for both retailing and shipping bulk amounts of a heavy product. More particularly, the invention pertains to handled, side gusseted, easy open, non-resealing bags that, when sealed closed, are capable of carrying heavy loads without having the handles separate from the bag. The invention further pertains to side gusseted bags that include carry handles that attach to the bag without requiring a registration between the handle and the bag during attachment of the handle to the bag.

BACKGROUND

Generally, traditional shipping bags have been assembled from a paper or poly woven sheet material that is formed into a tube and then sealed on the ends with an adhesive, thermal weld, or stitching. A seam adjoining the sides of the sheet material may be thermally welded or sealed with an adhesive. When stitching the ends together, it may be desirable to provide a reinforcing tape on a side of the bag to reduce the likelihood that the sides of the bag pull apart from the stitching. However, because the reinforcing tape is thicker which requires a greater force for a stitching needle to penetrate and the acceptance of using reinforcing tape on only one side of the bag, the reinforcing tape is typically only placed on one side of the bag.

When shipping or displaying bulk amounts of a product it may be desirable to include an amount of the bulk material contained within the bags that exceeds thirty pounds. The bags may be gusseted so that they lay flat in storage but expand to contain the larger quantities of bulk material. The heavier materials contained within the bag further requires a sealed bag capable of withstanding heavier loads.

Oftentimes it is desirable to provide a handle to allow the user to carry the heavy bags primarily hanging to the user's sides so that the user may use shoulder muscles rather than back muscles to carry the bags. Attaching a handle to the bag requires an attachment that does not tear away from the bag when the handle is used to lift a heavy load within the bag. The bag of the present invention includes finger holds that form a handle that is capable of having a load contained within the bag weighing more than forty pounds without separating from the woven bag. Additionally, centering the opening of the handle between the two longitudinal sides of the bag balances the weight of the bag when the bag is by the handle. The centering of the handle relative to the sides of the bag may require additional tools and processes during the manufacturing of the bags. Further, the bag assembly may require a time consuming registration process to align the handles with the bags before attaching the handle to the bag.

SUMMARY

Embodiments according to aspects of the invention provides a handle that attaches to either end of a bag without requiring a time consuming registration process between the bag and handle. Further aspects of the invention include a cover tape having a handle incorporated into the cover tape that is easily sewn to the bag and that includes a pre-fold in the cover tape to engage an end of the bag in a manner that reduces the overall length of the shipping bag.

These and other embodiments according to aspects of the invention include a bag or sack for holding heavy bulk product. The bag is made from a woven sheet having opposing edges interconnected at a seam extending between first and second ends of the sheet and having opposing sides interconnected with opposing gussets, wherein the gussets extend longitudinally between the first and second ends. Cover tape folds over and encloses the second end and overlaps both opposing sides. The cover tape is made from a laminate woven strip that is easily penetrated by a stitching needle. The cover tape includes first and second opposing longitudinal edges defining a width of the strip. A pre-crease or fold extends longitudinally along the strip between the first and second opposing longitudinal edges. Further, the strip has a plurality of three sided perforated finger holds die cut into the strip and arranged along a first longitudinal edge or along both longitudinal edges of the strip. The cover tape folds over both sides of an end of the bag and is attached to the bag with a stitching that extends through woven cover tape and bag and engages both sides of the cover tape to the bag.

Aspects of the invention may include a bag formed from a woven web material having a seam in the bag formed by overlapping side edges of the woven web sheet material. An e-z open strip may be sewn to both the cover tape and the woven bag that a user may use to remove the stitching from the bag. The cover tape may further include indicia printed on a layer of the laminate woven strip wherein the indicia does not require a registration step to align the indicia with the width of the woven bag during the manufacturing process. Also, the three sided perforated finger holds are sized to create finger holds within the cover tape without eliminating material from the cover tape. Additionally, the plurality of perforations may be spaced apart in sets of four perforations such that an outer distance between the set of four perforations ranges between four and six inches.

Another embodiment according to aspects of the invention includes a woven sheet having a cover tape attached thereto that form a bag having an opposing open end. The woven sheet has opposing edges interconnected at a seam extending between first and second ends of the sheet and has opposing sides interconnected with opposing gussets, wherein the gussets extend longitudinally between the first and second ends. The cover tape folds over and encloses the second end of the sheet and overlaps both opposing sides to enclose one end of the sheet and form the bag having an opening at the other opposing end. The cover tape is comprised of a laminate woven strip having first and second opposing longitudinal edges defining a width of the strip. The cover tape also includes a pre-crease extending longitudinally along the strip between the first and second opposing longitudinal edges and the strip has a plurality of three sided perforated finger holds die cut into the strip and arranged along a first longitudinal edge of the strip. Indicia is printed on a layer of the laminate woven strip and an e-z open strip is aligned with the cover tape attached to the bag with a stitching that attaches the cover tape and e-z open strip to the woven bag.

According to aspects of the invention a bag capable of holding heavy bulk product is formed by conveying woven web sheet material through a tool that forms opposing gussets on the sheet material. Once the gussets are formed on the sheet material, then opposing side edges of the sheet material are overlapped to form an overlapped sheet material having opposing sides and a relatively planar front and back. The overlapping edges of the overlapped sheet material are adhered or sealed together, forming an enclosed interior of the overlapping sheet. A cover tape covers a first end of the overlapped sheet material and engages both opposing sides of the overlapped sheet material. The overlapping cover tape includes a laminate woven strip having first and second opposing longitudinal edges defining a width of the strip. A pre-crease in the cover tape extends longitudinally along the strip between the first and second opposing longitudinal edges. The cover tape is stitched to the overlapping sheet material in a manner such that the gussets overlap and the bag lays flat when empty. A plurality of three sided die cut perforations are arranged along a first longitudinal edge of the strip. The pre-crease of the strip is positioned adjacent the first end of the overlapped sheet material. The cover tape is affixed to both opposing sides of the overlapped sheet material, wherein the three sided die cuts are not registered relative to a width of the overlapped sheet material.

The process of forming the bag may further include the step of affixing an e-z open strip to the overlapped sheet material at the same time that the cover tape is affixed to the overlapped sheet material. Also, the step of affixing the cover tape is accomplished by sewing the cover tape to the sheet material. Further, the cover tape may include indicia printed on a layer of the laminate woven strip wherein the indicia does not require registration relative to a width of the overlapped sheet material. Another aspect of the present invention provides a cover tape having multiple handles incorporated into the cover tape such that the cover tape may be affixed to a plurality of bags comprised of an overlapped sheet material wherein a width of each of the overlapped sheet material of the plurality of overlapped sheet material may not be equal.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

Figure 1:
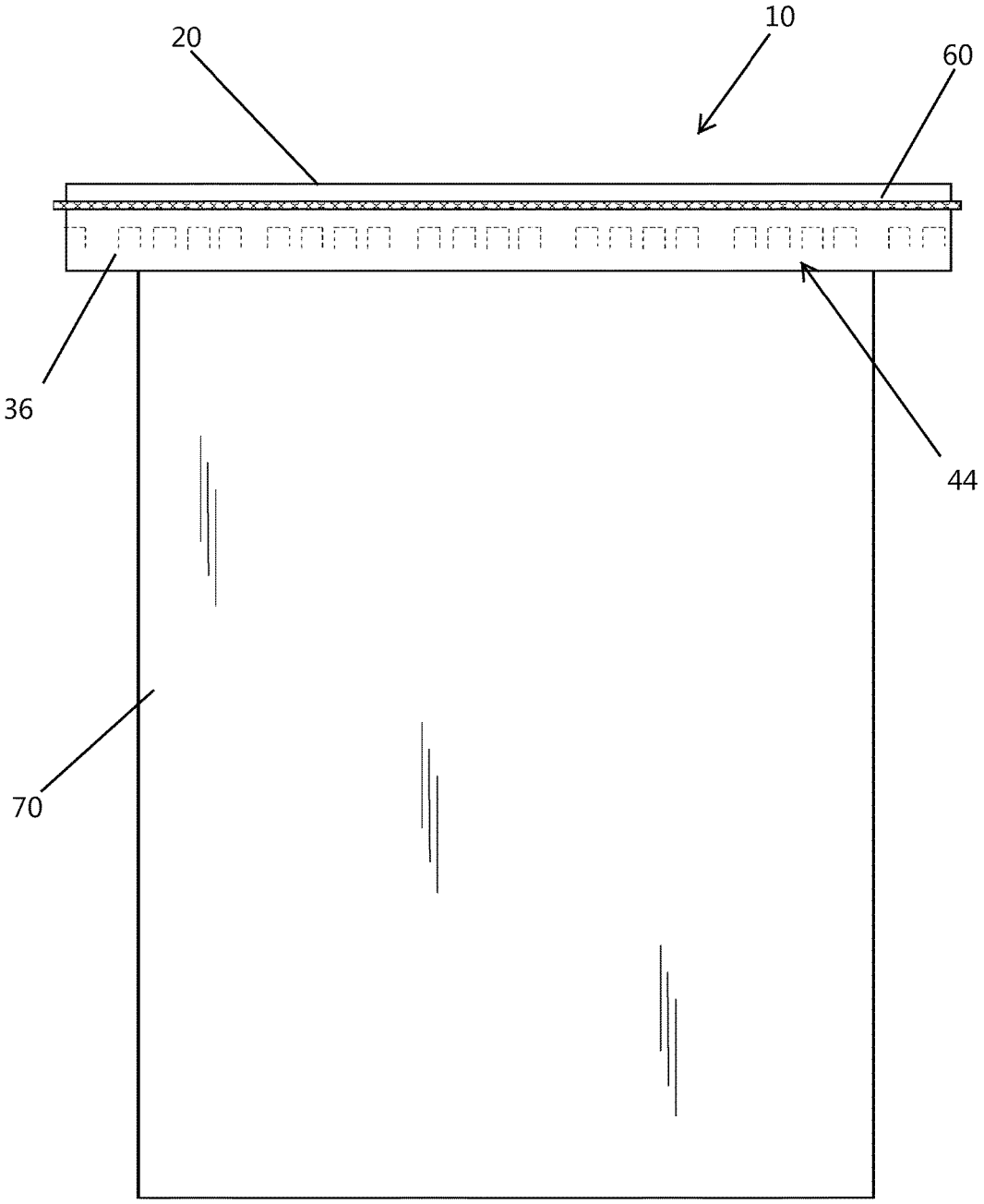
FIG. 1 is a front side view of an assembled shipping bag apparatus of the present invention.

The apparatus 10 of the present invention is particularly well suited for shipping or retailing heavy bulk product. The shipping bag 10 is made from a sheet material 70 and cover tape 20 of the present invention. With reference to the Figures, various embodiments according to aspects of the invention will be described in greater detail. With reference to FIG. 1, the shipping bag 10 is shown having cover tape 20 and e-z open zip strip 60 attached to the woven sheet material 70 forming the bag. The cover tape 20 is shown having three sided perforated finger holds 36 arranged and spaced apart in sets of four perforations 44 such that an outer distance between the set of four perforations 44 ranges between four and six inches. The spacing is particularly well suited to accommodate the size of various user's fingers and hands and to eliminate the need to register the finger holds or handle to the width of the woven sheet material forming the bag.

Figure 2:
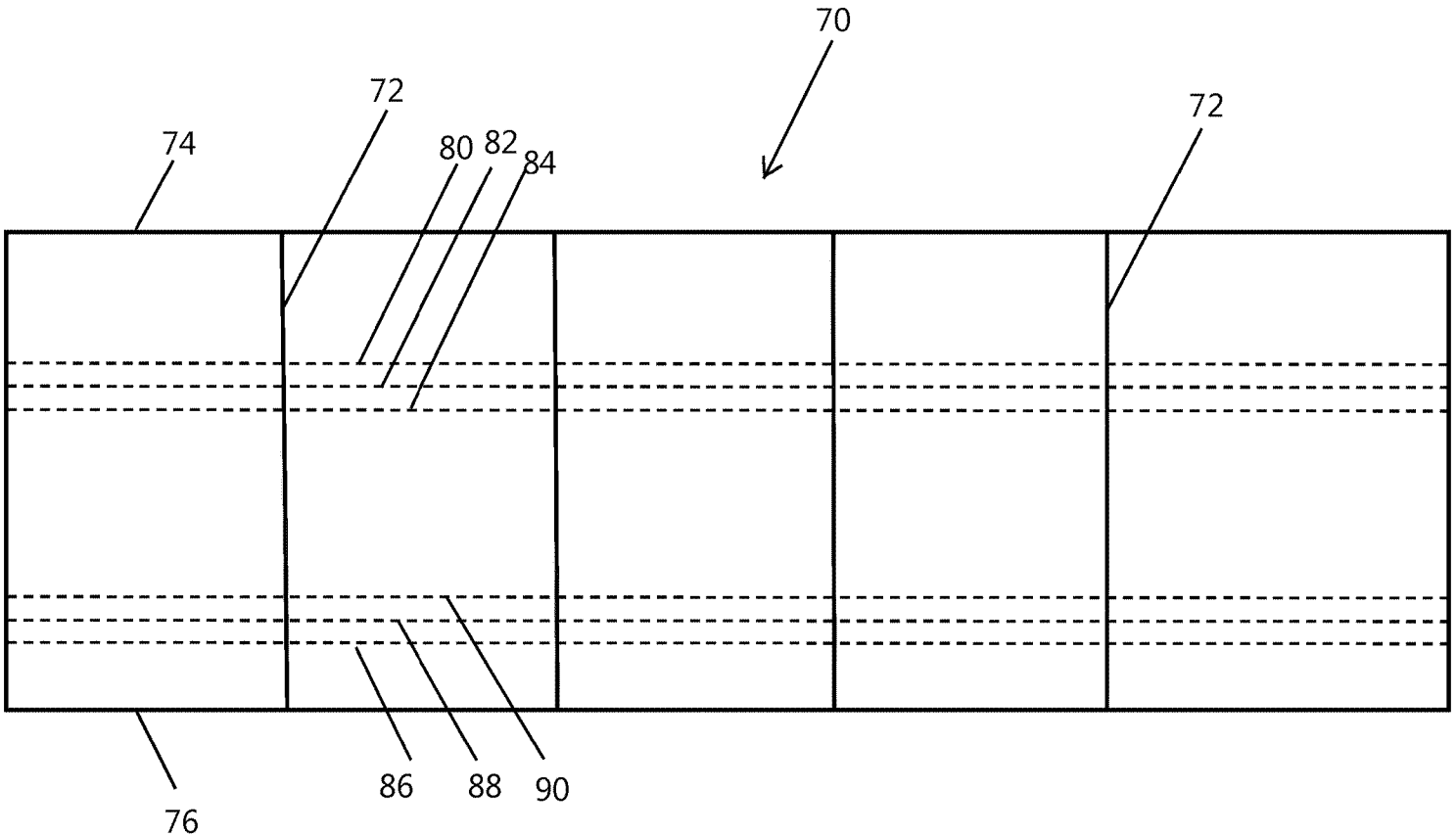
FIG. 2 is a top view of multiple sheet material having gusset lines identified that may be used to form the assembled shipping bag apparatus of the type shown in FIG. 1.
Figure 3:
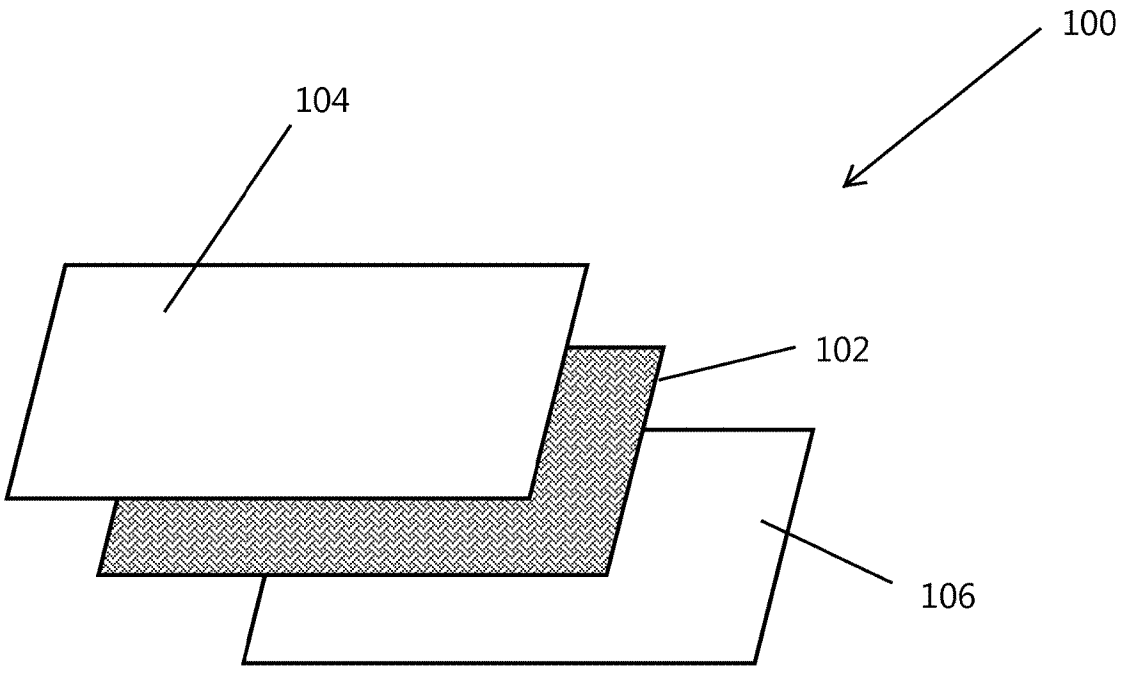
FIG. 3 is a perspective exploded view of a woven laminate material used to form the sheet material and cover tape of the assembled shipping bag apparatus of the type shown in FIG. 1.

Referring to FIG. 2, multiple shipping bags 10 of the present invention are shown being formed from a continuous roll of poly woven sheet material. Perforations 72 divide the shipping bags and allow the bags formed on the roll to be simply separated and detached from the roll. The roll of sheet material includes a first edge 74 and second edge 76. When the bag 10 is separated from the roll the first and second edges extend longitudinally along the sheet material and are overlapped and engaged together. Gusset fold lines 80, 82, 84, 86, 88, and 90 are identified on the continuous roll of sheet material. The gussets allow a portion of the woven sheet material 70 to overlap and lay flat when empty and to expand when the bag is filled. Both the sheet material 70 and cover tape 20 may be manufactured from a laminate poly woven material of known suitable construction. An exemplary laminate woven material 100 is shown in FIG. 3. The laminate 100 is shown having a woven layer 102 sandwiched between a top layer 104 and bottom layer 106. Indicia 26 and symbols 28 (illustrated by way of example in FIG. 4) may be printed on a layer of the laminate. Those skilled in the art will appreciate that the laminate may be provided with more or less layers of the laminate.

Figure 4:
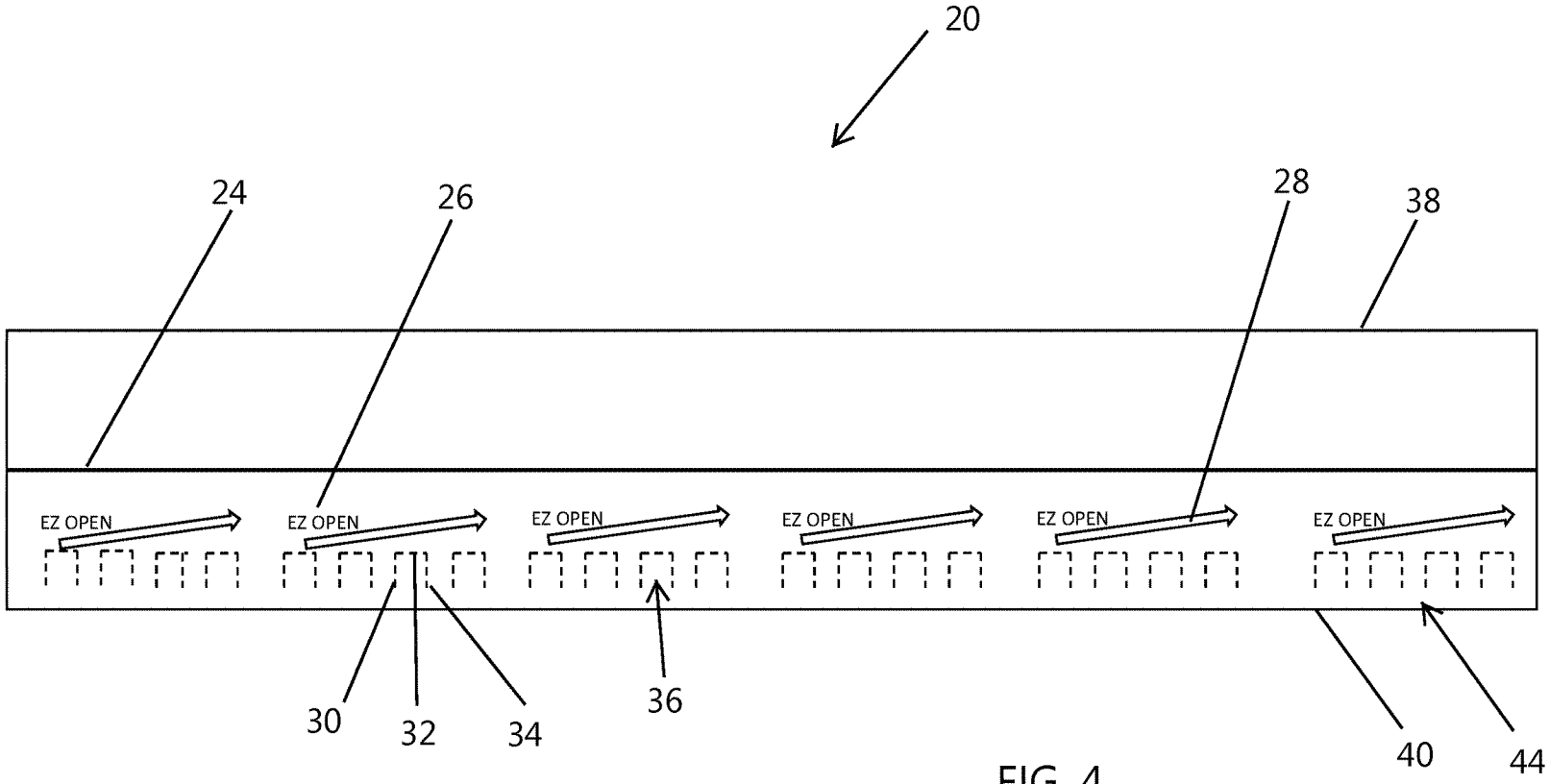
FIG. 4 is a top view of a continuous cover tape of the type used to form the assembled shipping bag apparatus of the type shown in FIG. 1.

FIG. 4 illustrates an exemplary cover tape 20 in a continuous roll form according to aspects of the invention. The cover tape 20 includes longitudinal opposing edges 38 and 40 and a fold line or pre-crease 24 extending longitudinally between the opposing edges 38 and 40. The pre-crease 24 allows the cover tape to be engaged to the second end 16 of the bag closer to an edge of the bag during the manufacturing process. Three perforations 30, 32, and 34 form a three sides of a rectangle. When pressed, the laminate material separates along the perforations 30-34 to form an aperture of suitable size for a finger. A tab of the laminate material bends away from the aperture but does not separate from the cover tape 20. When the material separates along the perforations the tab overlaps with the cover tape adjacent the finger hold and provides a thicker region that the finger engages when using the finger holds as a handle to lift the bag. Sets of four finger holds 44 form a handle and are spaced along the cover tape so that the cover tape may be applied to multiple bags in an assembly machine without requiring a registration between the position of the finger hold sets 44 on the cover tape 20 and the width of the bag 10. Indicia and symbols 26 and 28 may further assist a user to identify features of the bag 10.

Figure 5:
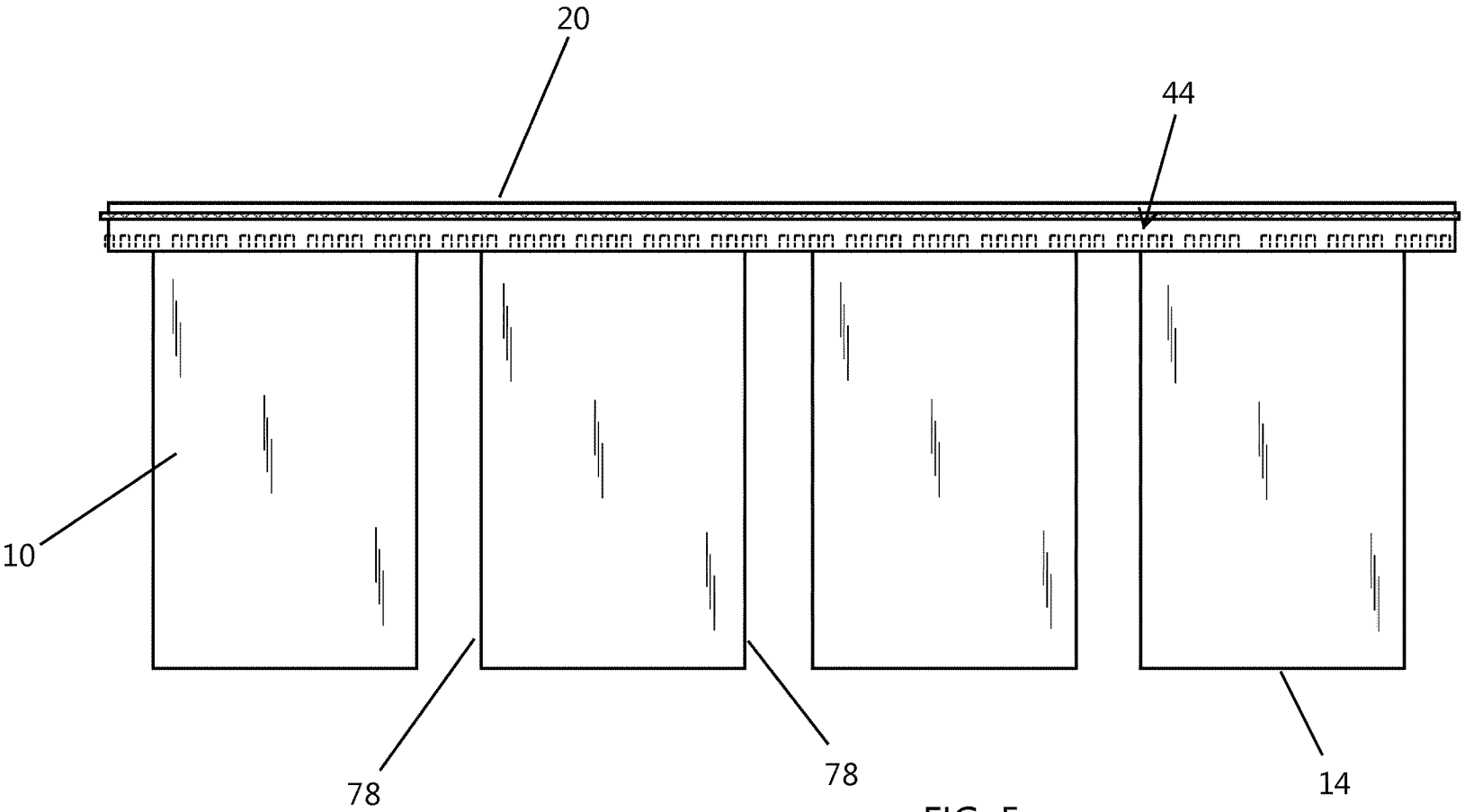
FIG. 5 is a side view of multiple assembled shipping bag apparatus of the present invention shown during the manufacturing process before cutting the cover tape to separate the bags.
Figure 6:
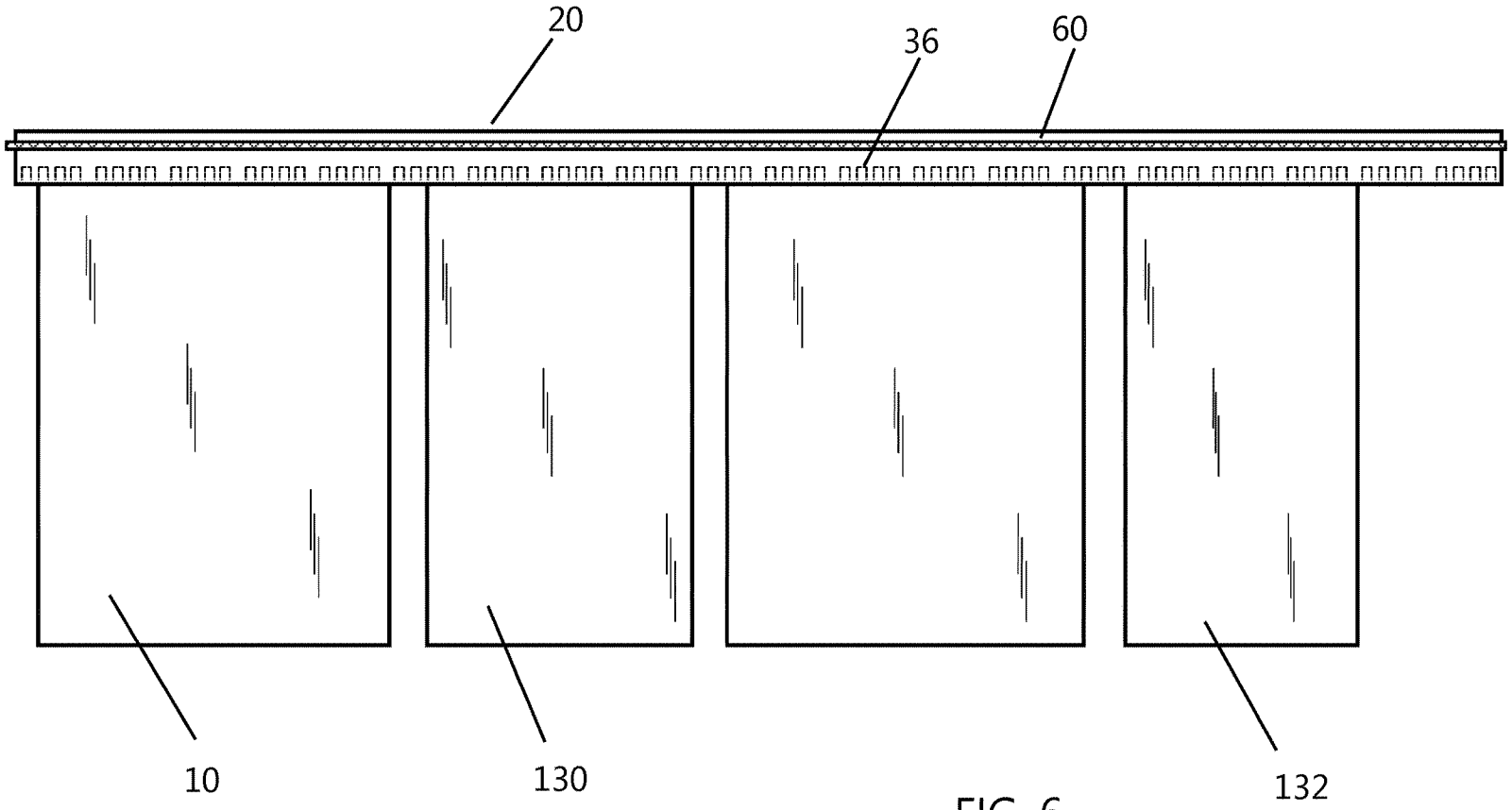
FIG. 6 is a side view of multiple assembled shipping bag apparatus of the present invention having varying widths and shown during the manufacturing process before cutting the cover tape to separate the bags.
Figure 7:
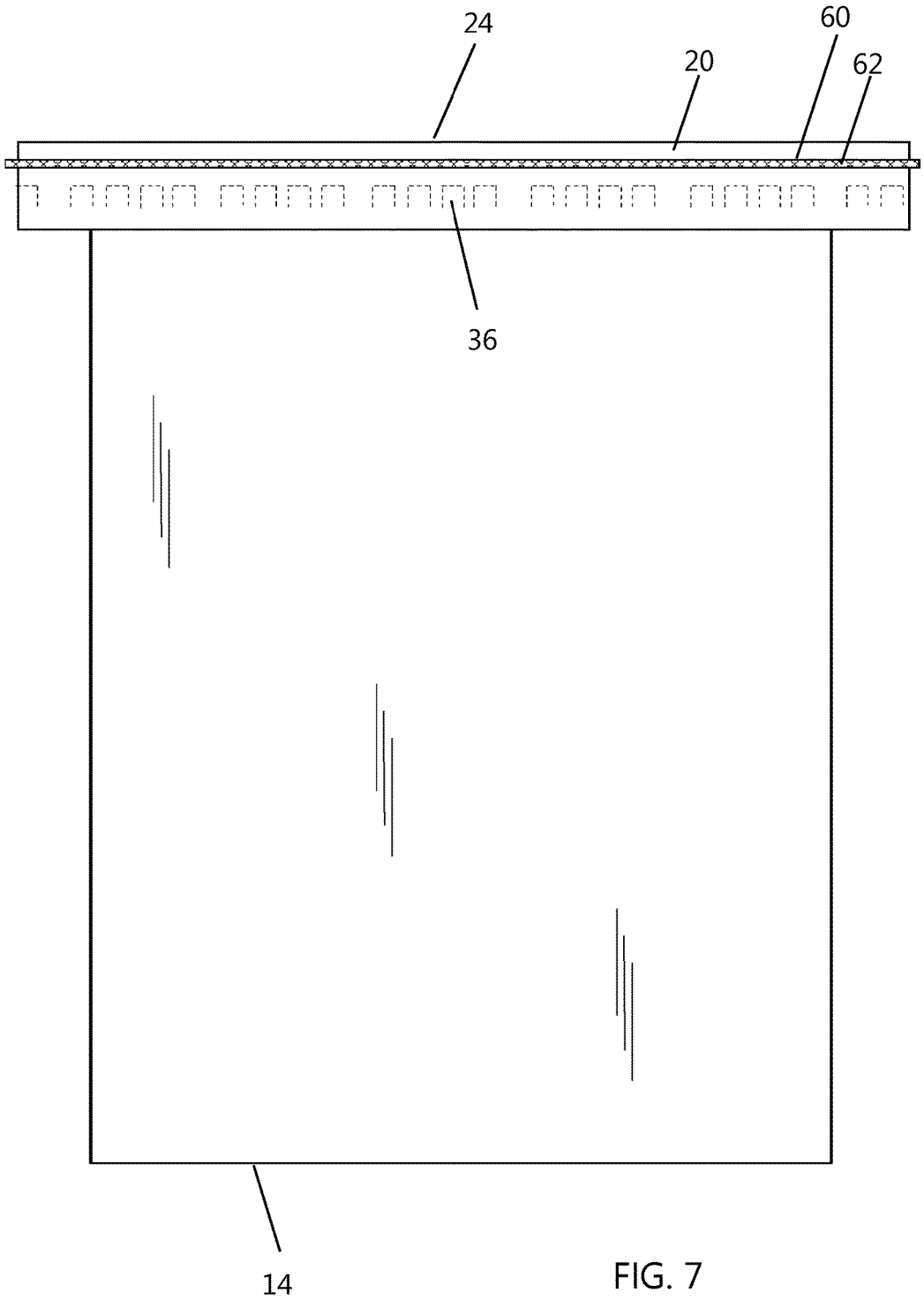
FIG. 7 is a front side view of an assembled shipping bag apparatus of the present invention of the type shown in FIG. 5.
Figure 8:
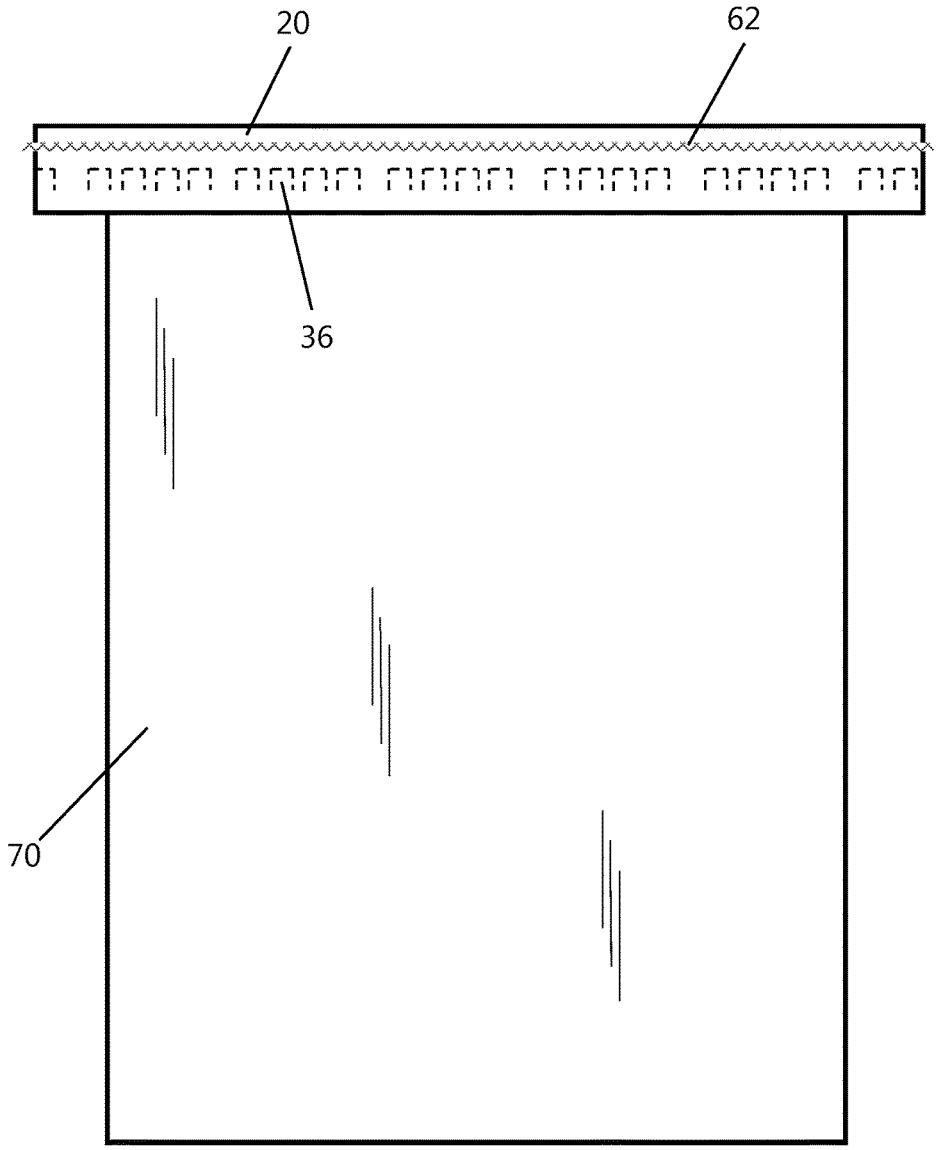
FIG. 8 is a front side view of an assembled shipping bag apparatus of the type shown in FIG. 7, shown without an e-z open strip.
Figure 9:
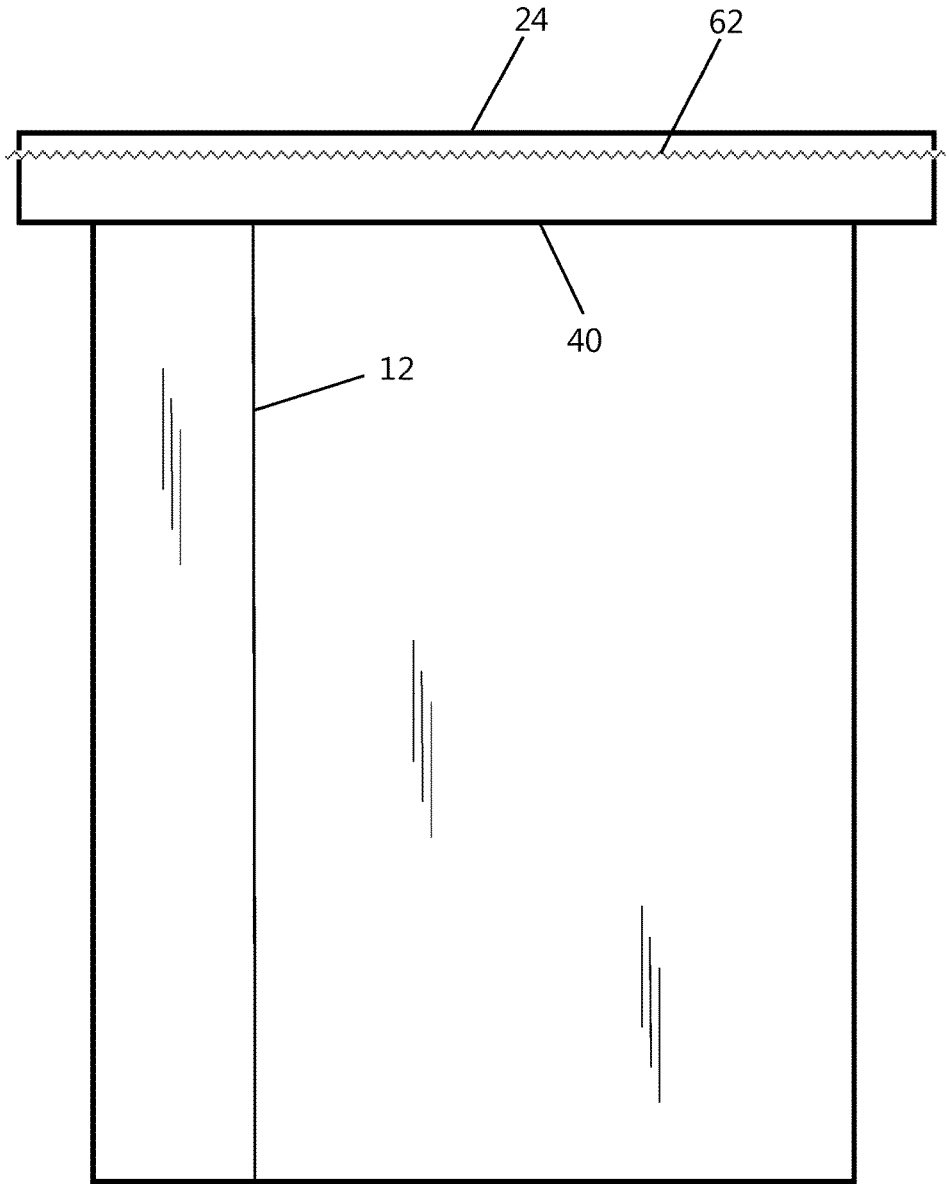
FIG. 9 is a back side view of the shipping bag apparatus of the type shown in FIG. 7.
Figure 10:
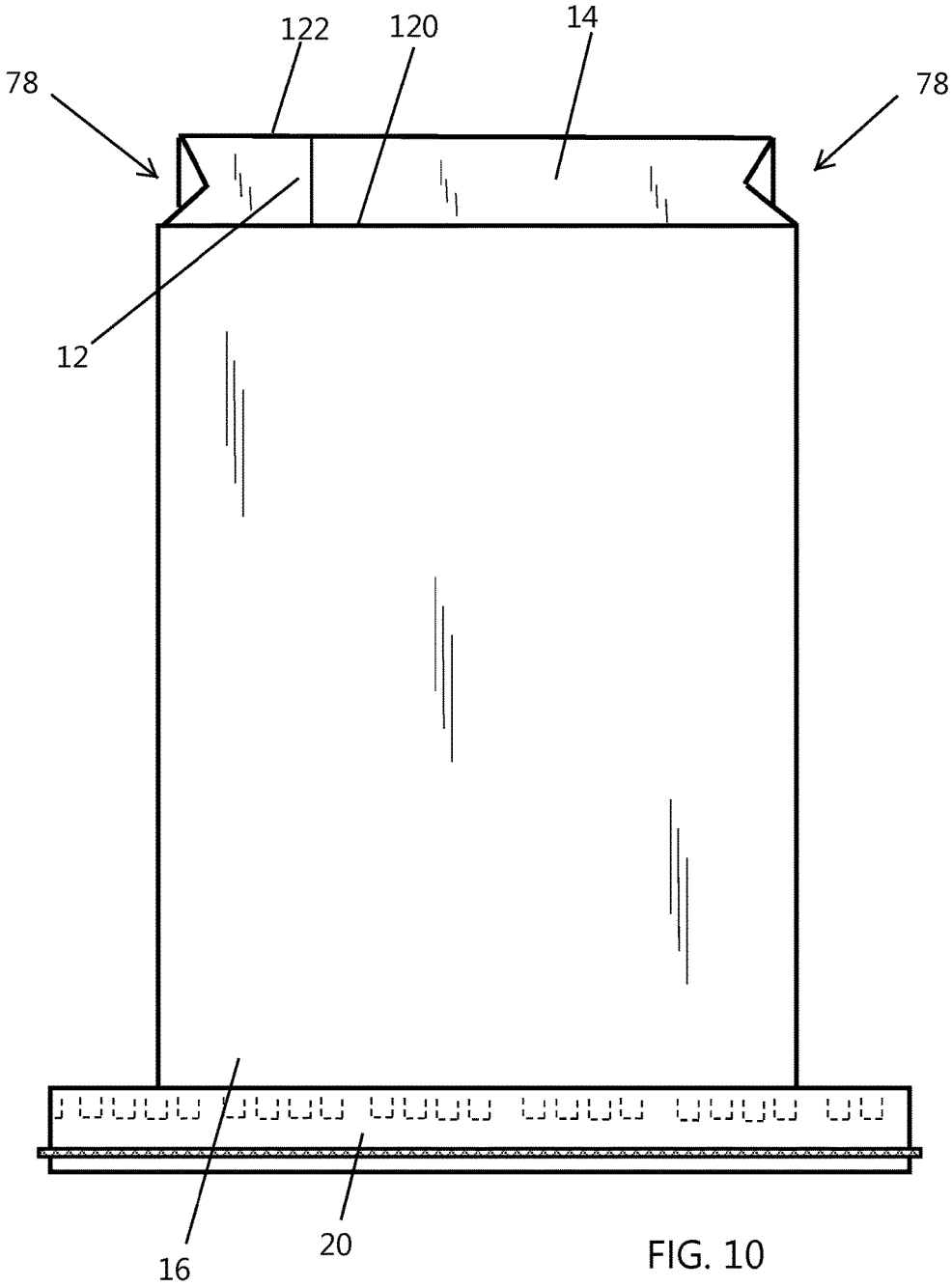
FIG. 10 is a front side perspective view of an assembled shipping bag apparatus of the present invention showing an open end of the bag.

FIGS. 5 and 6 illustrate an assembly of multiple bags 20. Side gussets 78 are folded inward to reduce the width of a flat and empty bag. Cover tape 20 is folded over the planar fronts 120 and backs 122 of the bag and is sewn to the woven sheet 20 with stitching 62. The bottom or open end 14 of the bags may be used to access the interior of the bag and fill the bag with desired amounts of material. Bags 10 having various widths (illustrated as bags 130 and 132) may be sewn to cover tape 20 through the same assembly line without the need to register the various widths of the bags to align the handles or finger hold sets relative to the bag.

Figure 11:
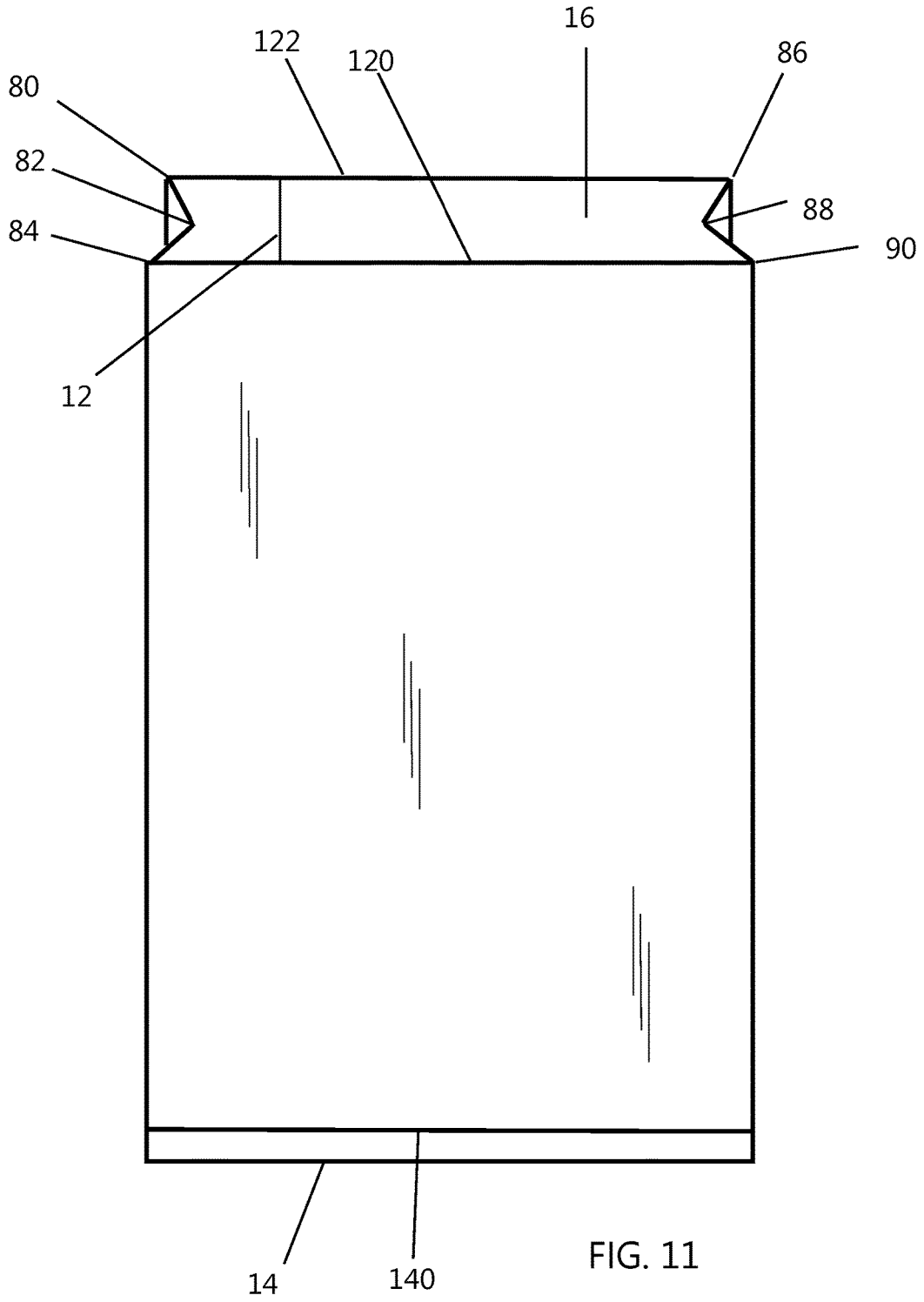
FIG. 11 is a front side perspective view of an assembled shipping bag apparatus of the present invention showing an open end of the bag.

FIGS. 7-11 illustrates various embodiments of the bag 10 in accordance with various aspects of the invention. The overlapping longitudinal edge 38 and 40 of the sheet material is thermal welded to form seam 12 in the bag. FIG. 11 illustrates a bag having a bottom thermal weld seam 140. In this embodiment, the bag would be filled before the cover tape is applied to the bag. Having described the constructional features of the invention the method of manufacture will now be described. A roll of woven web sheet material 70 is conveyed through a device of known suitable construction to form opposing gussets 78 (formed along fold lines 80-84 and 86-90) on the sheet material. The side edges 38 and 40 of the sheet material are overlapped to form a seam 12. The overlapping edges are adhered or sealed together. A first end of the overlapped sheet material is covered with a cover tape 20 in accordance with aspects of the invention such that the cover tape 20 engages both opposing sides (front 120 and back 122) of the overlapped sheet material. The pre-crease 24 of the strip 20 is positioned adjacent the first end 14 of the overlapped sheet material. The cover tape 20 is then affixed to both opposing sides 120 and 122 of the overlapped sheet material, wherein the three sided die cuts 30-34 are not registered relative to a width of the overlapped sheet material.

When the cover tape 20 is attached to the sheet material 70 an e-z open strip 60 may be aligned and attached to the overlapped sheet material at the same time that the cover tape is affixed to the overlapped sheet material. The cover tape and e-z strip may be affixed by sewing or stitching the cover tape to the sheet material. A roll of the cover tape 20 may be affixed to a plurality of the overlapped sheet material during an assembly process, wherein a width of each the overlapped sheet material of the plurality of overlapped sheet material is not necessary to be equal in order to have a set of finger holds or handle approximately centered between the longitudinal edges of the bag.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. An apparatus for holding heavy bulk product, the apparatus comprising:

a woven sheet having opposing edges interconnected at a seam extending between first and second ends of the sheet and having opposing sides interconnected with opposing gussets, said gussets extending longitudinally between the first and second ends;

cover tape folded over and enclosing the second end and overlapping both opposing sides to form a bag having an opening at said first end;

said cover tape comprised of a laminate woven strip having first and second opposing longitudinal edges defining a width of said strip; a pre-crease extending longitudinally along said strip between said first and second opposing longitudinal edges; and said strip having a plurality of three sided perforated finger holds die cut into said strip and arranged along a first longitudinal edge of the strip; and stitching attaching the cover tape to the woven bag.

2. The apparatus as recited in claim 1, wherein said bag is formed from a woven web material and said seam is formed from overlapping side edges of the sheet material.

3. The apparatus as recited in claim 1, further including an e-z open strip sewn to both said cover tape and said woven bag.

4. The apparatus as recited in claim 1 wherein said cover tape includes indicia printed on a layer of said laminate woven strip and wherein said indicia is not registered relative to a width of the woven bag.

5. The apparatus as recited in claim 1, wherein the three sided perforated finger holds are sized to create finger holds within the cover tape.

6. The apparatus as recited in claim 1, wherein said finger holds are created without eliminating material from the cover tape.

7. The apparatus as recited in claim 1, wherein said plurality of perforations are spaced apart in sets of four perforations such that an outer distance between the set of four perforations ranges between four and six inches.

8. The apparatus as recited in claim 1, wherein said stitching and cover tape withstands a weight of more than 40 pounds load within the bag without separating from the woven bag.

9. An apparatus for holding heavy bulk product, the apparatus comprising:

a woven sheet having opposing edges interconnected at a seam extending between first and second ends of the sheet and having opposing sides interconnected with opposing gussets, said gussets extending longitudinally between the first and second ends;

cover tape folded over and enclosing the second end and overlapping both opposing sides to form a bag having an opening at said first end;

said cover tape comprised of a laminate woven strip having first and second opposing longitudinal edges defining a width of said strip; a pre-crease extending longitudinally along said strip between said first and second opposing longitudinal edges; and said strip having a plurality of three sided perforated finger holds die cut into said strip and arranged along a first longitudinal edge of the strip;

said cover tape having indicia printed on a layer of said laminate woven strip;

an e-z open strip aligned with said cover tape; and stitching attaching the cover tape and e-z open strip to the woven bag.

10. The apparatus as recited in claim 9, wherein said woven bag is formed from a woven web sheet material and said seam is formed from overlapping side edges of the sheet material.

11. The apparatus as recited in claim 9, wherein the three sided perforated finger holds are sized to create finger holds within the cover tape.

12. The apparatus as recited in claim 9, wherein said finger holds are created without eliminating material from the cover tape.

13. The apparatus as recited in claim 9, wherein said plurality of perforations are spaced apart in sets of four perforations such that an outer distance between the set of four perforations ranges between four and six inches.

14. The apparatus as recited in claim 9, wherein said stitching and cover tape withstands a load within bag of more than 40 pounds without separating from the woven bag.

15. The method of forming a bag apparatus for holding heavy bulk product, said method comprising the steps of:

conveying woven web sheet material;

forming opposing gussets on the sheet material;

overlapping side edges of the sheet material to form an overlapped sheet material having opposing sides;

adhering or sealing together the overlapping edges of the overlapped sheet material;

covering a first end of the overlapped sheet material with a cover tape, said cover tape engages both opposing sides of the overlapped sheet material and said cover tape comprising:

a laminate woven strip having first and second opposing longitudinal edges defining a width of said strip;

a pre-crease extending longitudinally along said strip between said first and second opposing longitudinal edges;

said strip having a plurality of three sided die cut/perforations arranged along a first longitudinal edge of the strip;

positioning said pre-crease of said strip adjacent the first end of the overlapped sheet material; and affixing said cover tape to both opposing sides of the overlapped sheet material, wherein said three sided die cuts are not registered relative to a width of the overlapped sheet material.

16. The method according to claim 15, further including the step of affixing an e-z open strip to the overlapped sheet material at the same time that the cover tape is affixed to the overlapped sheet material.

17. The method according to claim 15 wherein the step of affixing requires sewing said cover tape to said sheet material.

18. The method according to claim 15 wherein said cover tape includes indicia printed on a layer of said laminate woven strip and wherein said indicia is not registered relative to a width of the overlapped sheet material.

19. The method according to claim 15, wherein the three sided perforations are sized to create finger holds within the cover tape.

20. The method according to claim 15, wherein said finger holds are created without eliminating material from the cover tape.

21. The method according to claim 15, wherein said plurality of perforations are spaced apart in sets of four perforations such that an outer distance between the set of four perforations ranges between four and six inches.

22. The method according to claim 15 further including affixing said cover tape to a plurality of said overlapped sheet material wherein a width of each the overlapped sheet material of the plurality of overlapped sheet material is not equal.

* * * * *